US007713105B2

(12) United States Patent
Barthold

(10) Patent No.: US 7,713,105 B2
(45) Date of Patent: May 11, 2010

(54) LAUNCHING DEVICE FOR A FLYING TOY

(75) Inventor: Mark Barthold, Torrance, CA (US)

(73) Assignee: Mattel, Inc., El Segundo, CA (US)

( * ) Notice: Subject to any disclaimer, the term of this patent is extended or adjusted under 35 U.S.C. 154(b) by 133 days.

(21) Appl. No.: 11/969,797

(22) Filed: Jan. 4, 2008

(65) Prior Publication Data

US 2009/0075554 A1 Mar. 19, 2009

Related U.S. Application Data

(60) Provisional application No. 60/972,819, filed on Sep. 17, 2007.

(51) Int. Cl.
*A63H 13/10* (2006.01)

(52) U.S. Cl. ..... 446/308; 446/62; 446/65

(58) Field of Classification Search ..... 446/308, 446/61, 62, 60, 63, 64, 65; 124/16
See application file for complete search history.

(56) References Cited

U.S. PATENT DOCUMENTS 2,089,594 A * 8/1937 Ballwanz ..... 124/21
3,068,612 A * 12/1962 Simpson ..... 446/65
3,918,197 A * 11/1975 Stanzel ..... 446/65
4,715,600 A 12/1987 Offutt
5,129,852 A * 7/1992 Crisci et al. ..... 446/60
6,036,574 A 3/2000 Halford
6,343,969 B1 2/2002 Spector
6,764,373 B1 7/2004 Osawa et al.
6,857,770 B2 * 2/2005 Moore ..... 362/554
7,004,813 B2 * 2/2006 Zuloff ..... 446/175
2006/0264146 A1 * 11/2006 Conrad ..... 446/57
2006/0270307 A1 * 11/2006 Montalvo et al. ..... 446/64
2006/0292958 A1 * 12/2006 Sun et al. ..... 446/63

* cited by examiner

*Primary Examiner*—Gene Kim
*Assistant Examiner*—Matthew B Stanczak
(74) *Attorney, Agent, or Firm*—The Mueller Law Office, P.C.

(57) ABSTRACT

The present invention relates to a launching device for a flying toy. The launching device facilitates the transition of the flying toy from a resting state to a flying state. The launching device may include elements for holding one or more parts of the flying toy in a retracted position while the flying toy is in a resting state and for releasing the parts when the flying toy launches into a flying state. According to the invention, the launching device includes a launch-assist mechanism that provides a force to facilitate the launch of the flying toy.

10 Claims, 14 Drawing Sheets

LAUNCHING DEVICE FOR A FLYING TOY

RELATED APPLICATION

This application claims priority to U.S. Provisional Patent Application No. 60/972,819 filed on Sep. 17, 2007 entitled "Launching Device for a Flying Toy," which is hereby incorporated by reference as if set forth in full in this application for all purposes.

FIELD OF THE INVENTION

The present invention relates to a launching device, and more specifically to launching devices for flying toys.

BACKGROUND OF THE INVENTION

Flying toys come in many different shapes and sizes. Some flying toys may be formed to resemble birds, bats, butterflies or other real or imaginary creatures. Other flying toys may be formed to resemble man-made devices, such as planes, gliders, space ships and the like. The flight of such toys may be generated by various mechanical and electrical components, including springs, levers, wings and motors. Some flying toys require assistance from a user to initiate flight, and other flying toys may initiate flight without the assistance of a user. Flying toys in the later category may initiate flight from various locations, including but not limited to locations on the ground and locations on or associated with elevated surfaces.

Flying toys that are capable at least in part of initiating their own flight may benefit from the assistance of a launching device. A properly configured launching device can substantially improve the flight characteristics of the corresponding flying toy by providing mechanical assistance during the launch of the flying toy. Launching devices may also significantly improve the play value of a flying toy by incorporating characteristics that are consistent with the theme of the corresponding flying toy. For example, a flying toy that is formed to resemble a bird can benefit from a launching device that is formed to resemble a perch.

Despite substantial success in the market place on the part of flying toys, there remains a continuing need for more interesting and exciting flying toys and for launching devices that enhance the flying capabilities as well as the play value of such toys.

SUMMARY OF THE INVENTION

The present invention relates to a launching device for a flying toy. The launching device facilitates the transition of the flying toy from a resting state to a flying state. The launching device may include elements for holding one or more parts of the flying toy in a retracted position while the flying toy is in a resting state and for releasing the parts when the flying toy launches into a flying state. According to the invention, the launching device includes a launch-assist mechanism that provides a force to facilitate the launch of the flying toy.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION

Figure 1:
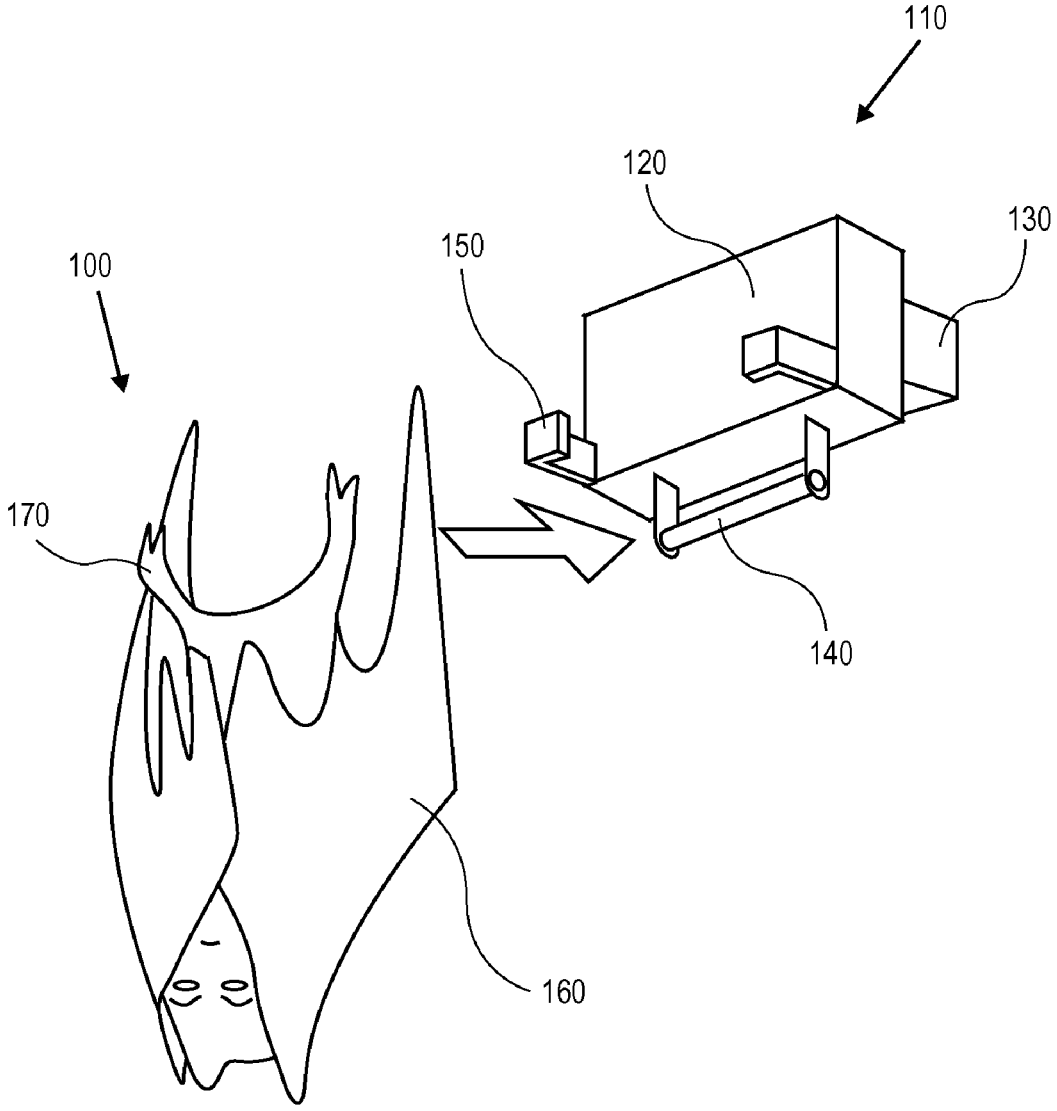
FIGS. 1 illustrates an exemplary embodiment of a flying toy and launching device in accordance with the present invention.
Figure 2:
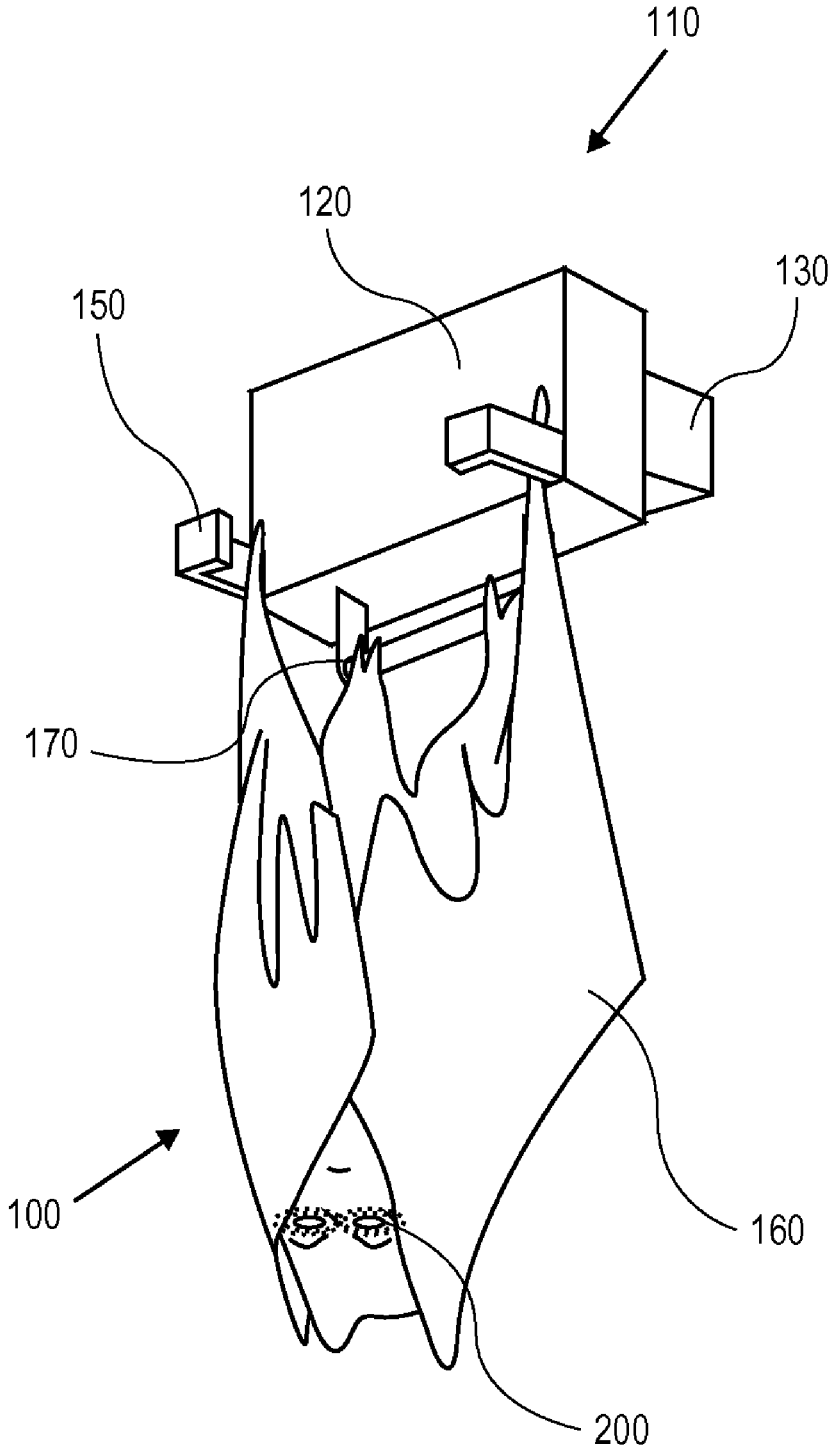
FIG. 2 illustrates the flying toy and launching device of FIG. 1 in the resting state.
Figure 3:
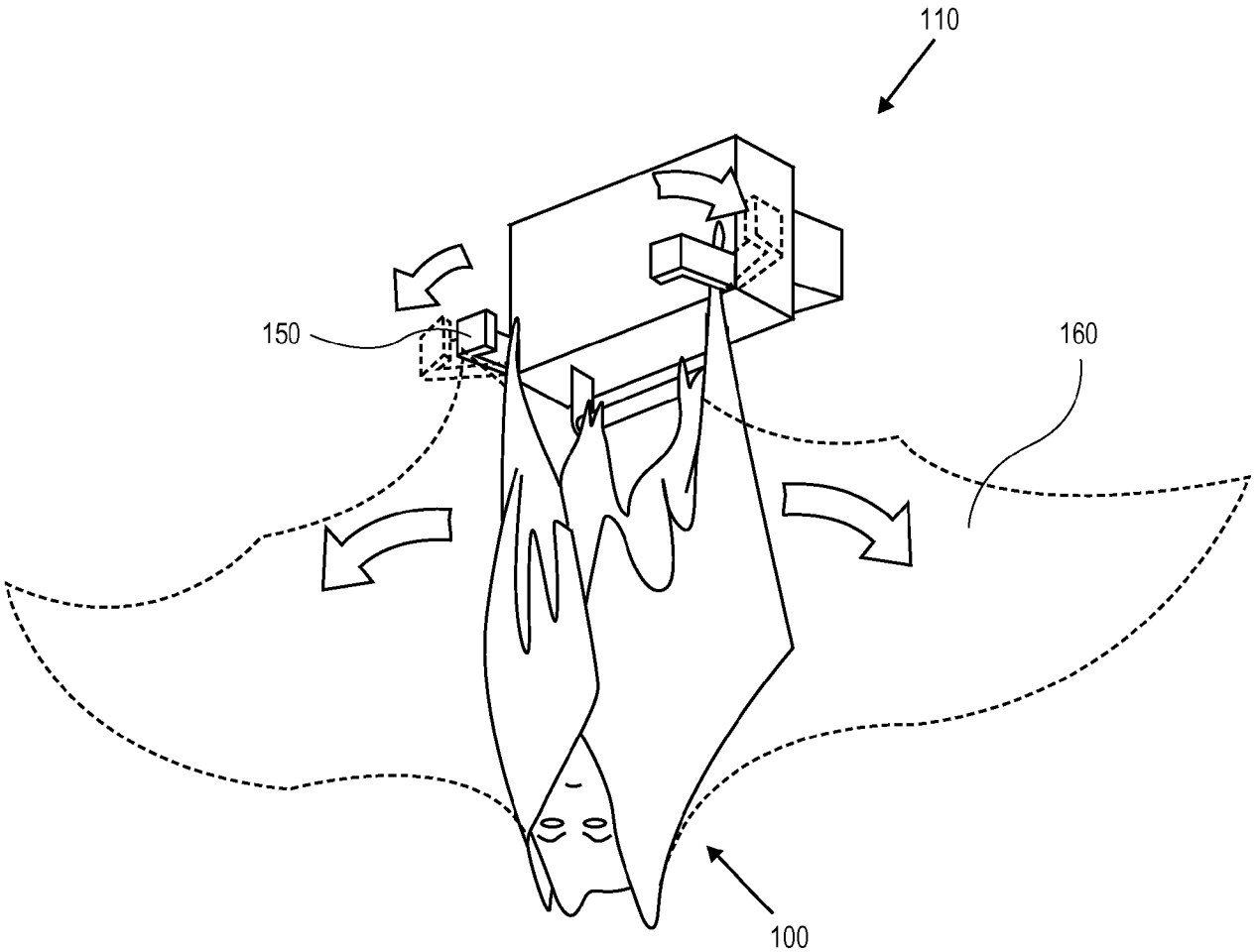
FIG. 3 illustrates the flying toy and a first embodiment of a launching device of in the launching state.
Figure 4:
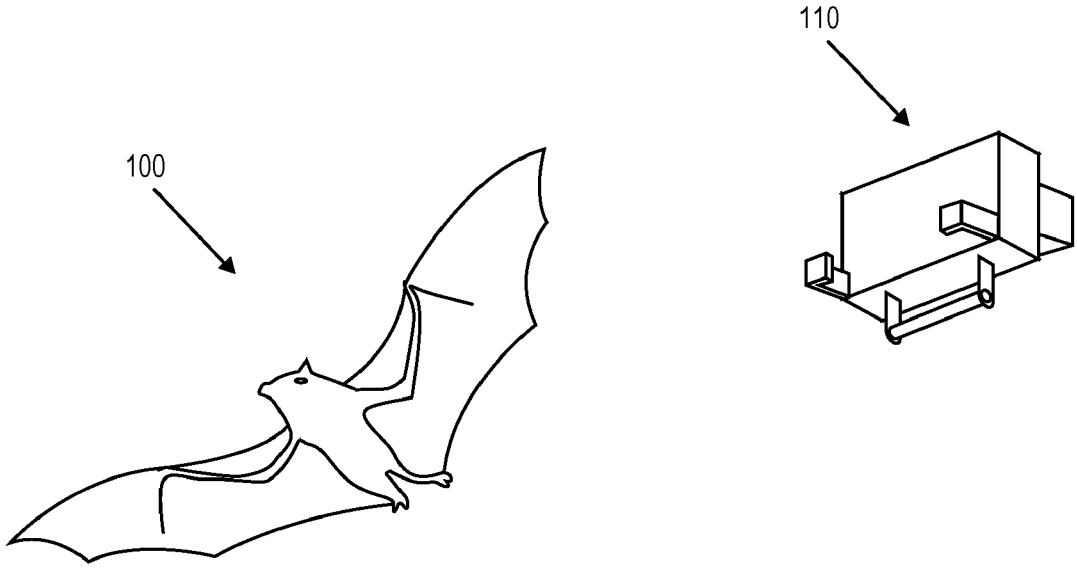
FIG. 4 illustrates the flying toy and launching device of FIG. 1 in the flying state.

FIGS. 1 thru 4 illustrate an exemplary embodiment of a flying toy 100 and a launching device 110 in accordance with the present invention. As an overview, FIG. 1 illustrates the flying toy 100 and the launching device 110 separated from each other. FIG. 2 illustrates the flying toy 100 and the launching device 110 joined in a resting state. FIG. 3 illustrates the flying toy 100 and the launching device 110 in a launching state. FIG. 4 illustrates the flying toy 100 and the launching device 110 in a flying state.

The flying toy 100 may be formed to resemble various flying creatures, such as a bird, bat, butterfly or the like or various man-made flying devices, such as a plane, a glider or the like or other non-flying objects such as an action figure, a Barbie® doll or the like. For purposes of illustration, the flying toy 100 is shown to resemble a bat. The flying toy 100 has a matching launching device 110 to facilitate the launch of the flying toy 100. Returning to FIG. 1, the launching device 110 includes a housing 120 for housing various mechanical and electrical components (not shown in FIG. 1). These mechanical and electrical components may facilitate in the launching of the flying toy 100 and may perform various supporting functions to enhance the play value of the flying toy 100.

The supporting functions may include various sound, light and motion effects. The sound, light and motion effects may correspond to the theme of the flying toy. For example, for the bat embodiment illustrated in FIGS. 1 thru 4, the launching device may produce bat-like screeching sounds. The supporting functions of the launching device 110 may also include automatic sensing functions for automatically triggering the flight of the flying toy 100. For example, the launching device 110 may house a motion sensor, sound sensor, light sensor or other sensor that triggers the flight of the flying toy 100. In this example, a person entering a room or opening a closet door may trigger flight of the flying toy.

The launching device 110 may include a bracket 130 for mounting the launching device to various surfaces. The bracket 130 may be an angle bracket with thru-holes for various connectors, such as nails or screws. The bracket 130 may also be a mounting clamp with a shape configured to mount the launching device 110 on a chair. Alternatively, the bracket 130 may be formed as a multi-purpose bracket by incorporating an angle bracket and a mounting clamp. Other standard mounting elements are also possible.

The launching device 110 may include a support bar 140 that is configured to match a linking element 170 located on the flying toy 100 in order to provide gravity support to the flying toy 100 while it is in a resting position as shown in FIG. 2. The support bar 140 may include, for example, a substantially cylindrical rod having a diameter slightly smaller than the inner diameter of a matching semicircular linking element 170 located on the flying toy 100. The linking element 170 may be formed, for example, as the feet or as other parts of the flying toy 100 that are consistent with the theme of the flying toy 100. The support bar 140 and linking element 170 of one exemplary embodiment are discussed in greater detail with reference to FIG. 5 below.

The launching device may provide power to devices within the flying toy to enhance play value while keeping the weight of the flying toy as light as possible. As shown in FIG. 2, support bar 140 may include electrical contacts coupled to an electrical source, such as a battery, located within launching device 110. Matching electrical contacts are also located in linking element 170 so that when flying toy 100 is in the resting position, power is provided from the electrical source through support bar 140 and through linking element 170 to a to light source or other device requiring power. The light source may include light-emitting diodes (LEDs) that are positioned in the eyes or on other places located on flying toy 100.

In the resting position shown in FIG. 2, the flying toy may include retractable wings 160 and the launching device may include one or more holding elements 150 for holding the wings 160 or other portions of the flying toy 100 in a temporarily fixed configuration. The holding elements 150 may transition from a closed to an open configuration, as illustrated in FIG. 3, to permit the retractable wings 160 to extend and open. Once the retractable wings 160 are extended and opened, they are free to facilitate the flight of the flying toy by, for example, flapping in a bird-like motion or, in the case of fixed position wings, by providing an air foil for gliding. In this embodiment, after the holding elements 150 release the wings 160, the flying toy 100 is propelled away from the launching device 110 by the launching device 110 as set forth below in further detail in FIG. 6.

Figure 5:
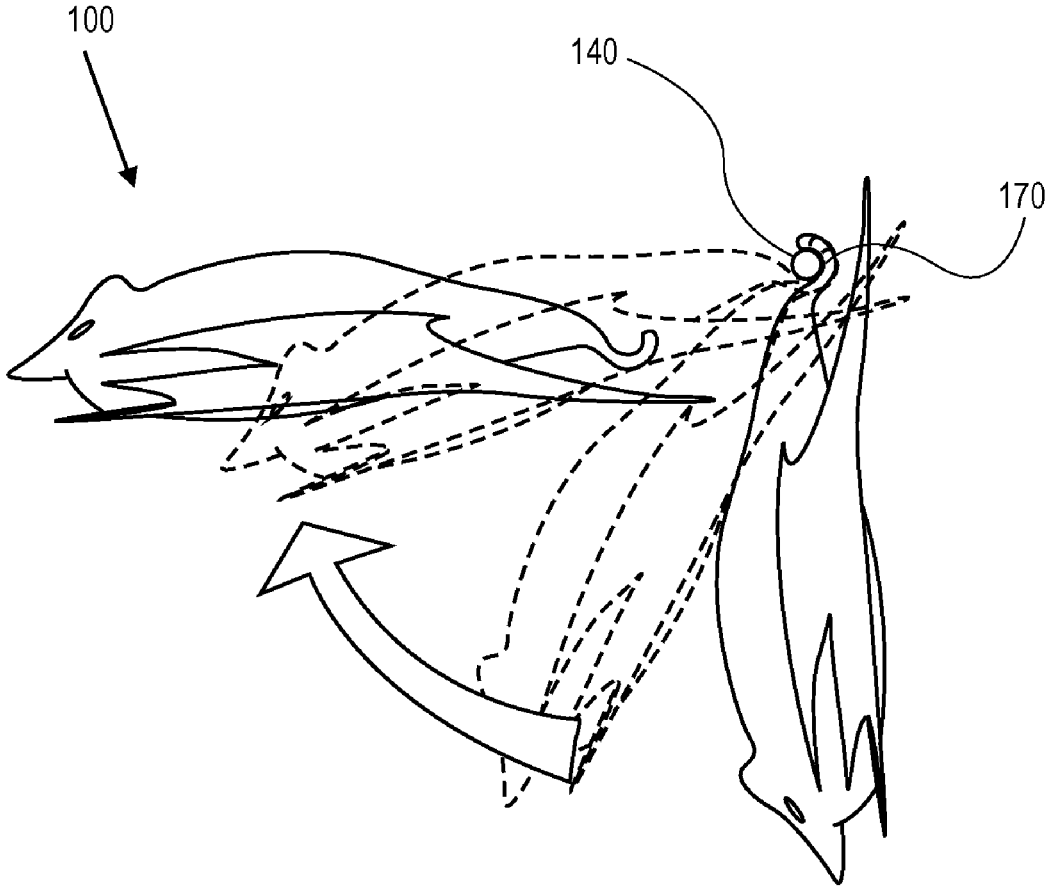
FIG. 5 illustrates another embodiment for the transitioning of the flying toy from a resting state to a flying state.

FIG. 5 illustrates another embodiment for transitioning of the flying toy 100 from a resting state to a flying state. In this embodiment, the resting state corresponds to the flying toy 100 being in a substantially vertical position with the semicircular linking element 170 of the flying toy 100 engaging the support bar 140 to provide gravity support for the flying toy 100. This substantially vertical position in this example is consistent with a bat that sleeps hanging upside down from its feet. In other embodiments, the resting state may be in a substantially vertical position so that the flying toy is in an upright position, such as a bird on a perch. The resting state may also be in a substantially horizontal or angled position.

Returning to FIG. 5, as the flying toy 100 pivots about the support bar 140 in an upward direction to a substantially horizontal position, the open portion of the linking element 170 rotates upward and gravity releases the flying toy 100 from the support bar 140. Once released from the support bar 140, the flying toy 100 is free to fly. This flight may be achieved with the aid of various mechanical and electrical components, including springs, levers, wings and motors.

Figure 6:
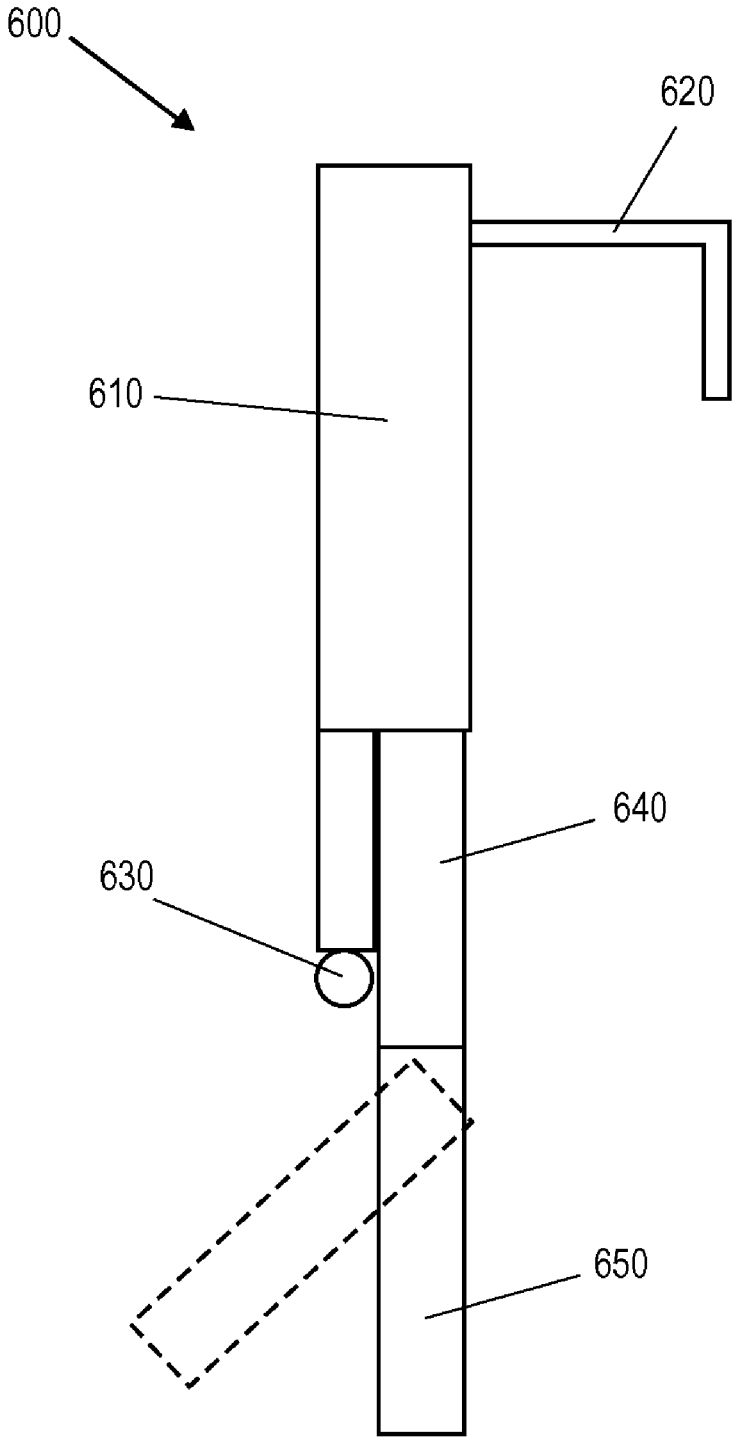
FIG. 6 illustrates another launching device in accordance with the first embodiment of the present invention.

FIG. 6 illustrates another launching device 600 in accordance with the first embodiment of the present invention. Launching device 600 provides a launching force that helps propel the corresponding flying toy away from the launching device 600 and toward a substantially horizontal flight position to facilitate flight. The launching device 600 may include a housing 610, a mounting bracket 620 and a support bar 630 similar to those described with reference to FIGS. 1 thru 4. In addition, the launching device 600 may include an extension 640 extending from the housing 610 and supporting or forming part of a launch-assist mechanism 650. The launch-assist mechanism 650 is configured to move quickly from a first position (as shown with solid lines) to a second position (as shown with dashed lines) in order to providing a launching force to help propel a flying toy into flight.

The launch-assist mechanism 650 may include various mechanical or electrical components capable of providing a force sufficient to at least partially lift and propel a flying toy. In one embodiment, the launch-assist mechanism 650 may include a spring-loaded lever that may be released through the press of a button by a user. This button may be located on launching device 600. Thus, after a user presses this button, launch assist-mechanism 650 is engaged, lifts the flying toy 100 into a substantially vertical position and propels the flying toy 100 away from the launching device 110 such that the flying toy 100 is ready to automatic flight. This automatic flight may be initiated by the release of the holding elements and/ or the triggering of the launch-assist mechanism or by other means.

Figure 7:
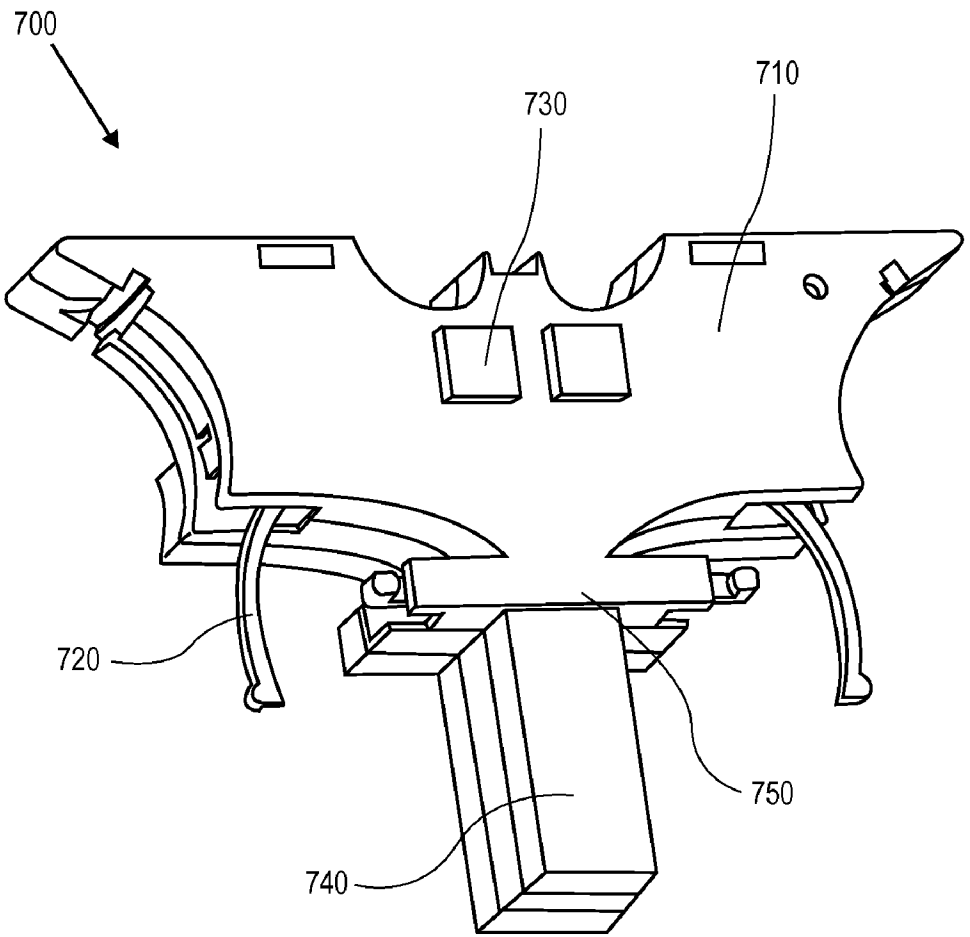
FIG. 7 illustrates another exemplary embodiment of a launching device in accordance with the present invention.

FIG. 7 illustrates another embodiment of a launching device 700 that includes a launch-assist mechanism 740. The launching device 700 may include a housing 710, holding elements 720 and a support bar 750 similar to those described with reference to FIGS. 1 thru 4. Support bar 750 may be configured to rotate such that the flying toy is rotated up into a substantially vertical position as set forth in FIG. 5 or into some other flight ready position. In addition, the launching device 700 may include one or more electrical or mechanical buttons 730 for accepting a user input to trigger the launch of the corresponding flying toy.

When a user presses or otherwise manipulates one or more of the buttons 730, the launch-assist mechanism 740 is released and moves quickly to a second position and in doing so provides a force for assisting the launch of the flying toy. One of buttons 730 may be configured to release holding element 720 so that the wings of the flying toy are placed in the open, flying position. Alternatively, the pressing of one of buttons 730 may rotate the support bar 750 such that the flying toy is placed in a flight ready position. One of buttons 730 may also initiate a two-step process. For example, the first step may be rotating of support bar 750 to place the flying toy in the flight ready position, and the second step may be engaging launching mechanism 740 to project the flying toy away from the launching device. The press of one of buttons 730 may also cause a chain reaction that includes (i) engaging a launching mechanism that pushes the flying toy both up and out away from the launching device and (ii) releasing holding elements 720 which then causes the wings to open far enough to engage an automatic wing flapping mechanism within the flying toy.

Figure 8:
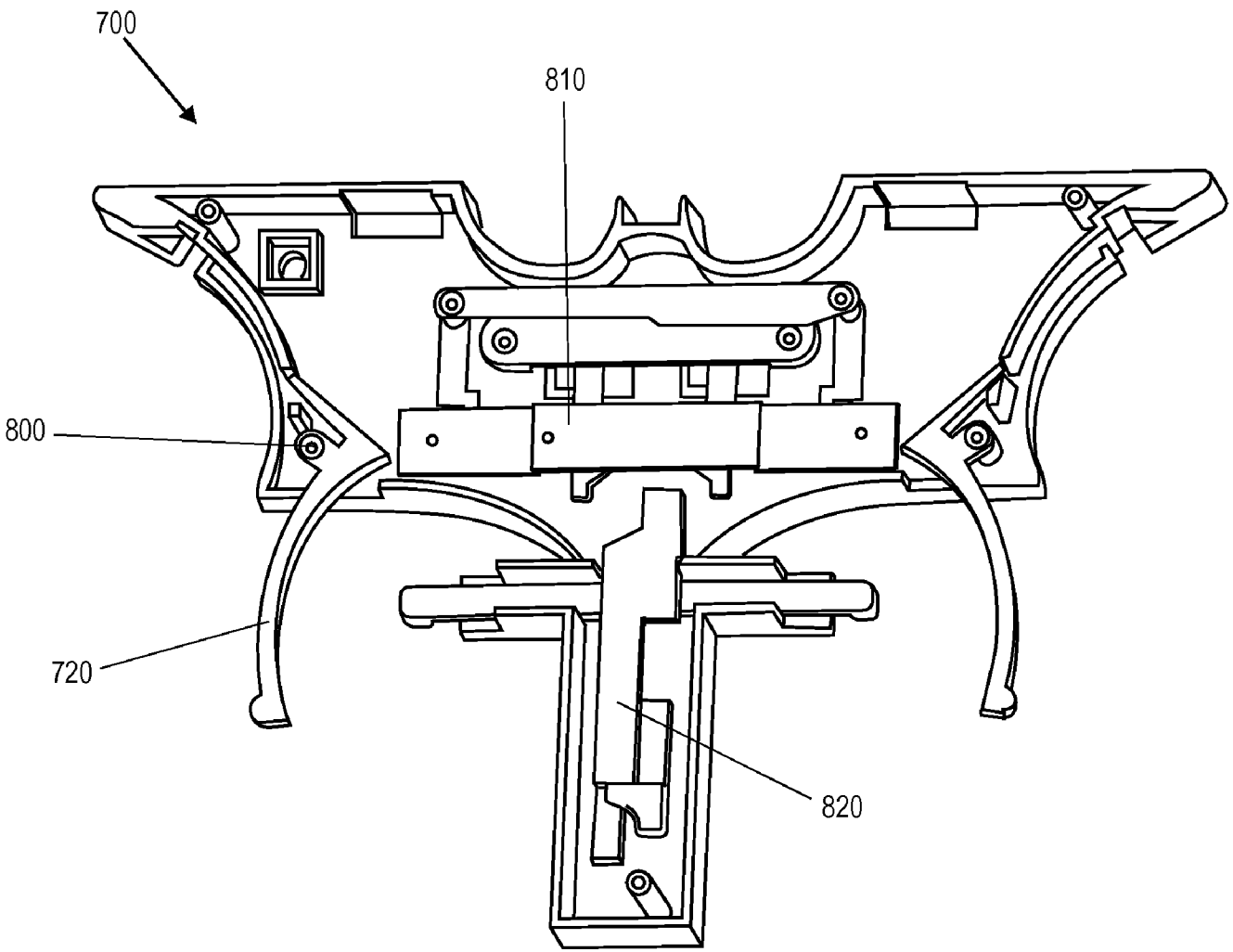
FIG. 8 illustrates a partially exploded view of the launching device of FIG. 7.

FIG. 8 illustrates a partially exploded view of the launching device 700 of FIG. 7. The launch-assist mechanism may include a spring-loaded lever 820 and various mechanical parts to hold and release the spring-loaded lever 820. Also, the holding elements 720 may pivot about an axle or hinge 800 and may be activated by various mechanical parts, for example part 810, that operate to hold and release the holding elements 720. Both holding elements 720 and spring-loaded lever 820 may be released by a user pressing one or more buttons located on the launching device.

Figure 9:
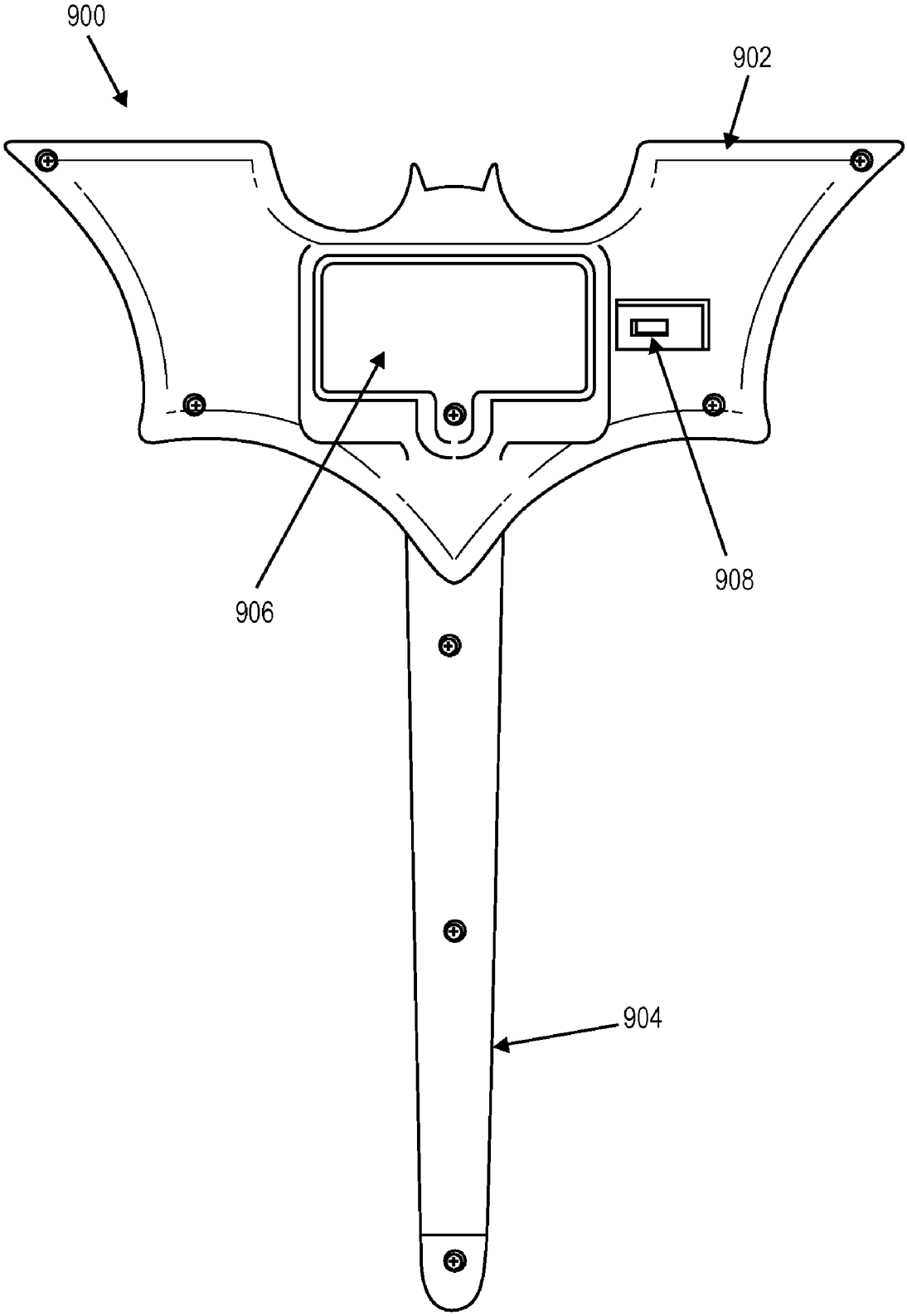
FIG. 9 illustrates a rear view of a final exemplary embodiment of a launching device in accordance with the present invention.

FIG. 9 illustrates a rear view of a final exemplary embodiment of a launching device 900. An upper housing 902 and a lower housing 904 include various mechanical and electrical components. As above, these components may facilitate in the launching of a flying toy and may perform various supporting functions to enhance the play value of the flying toy and launching device. Located on this back side of upper housing 902 are a battery door 906 and a switch 908. Battery door 906 allows a user to access and change one or more batteries which are providing power to various electronics located in housings 902 and 904. Switch 908 is a mode switch, and in this example, switch 908 is a three-position slider switch allowing for three modes of play, "off", "try-me" and "play". In the "off" mode, the electronic components within the housings 902 and 904 are disabled. In the "try-me" mode, certain features are be enabled. For example, the launching device may produce sounds associated with the character of the flying device or blinking lights may be enabled. In the "play" position, the launching device enters the normal operation mode as discussed below.

Figure 10:
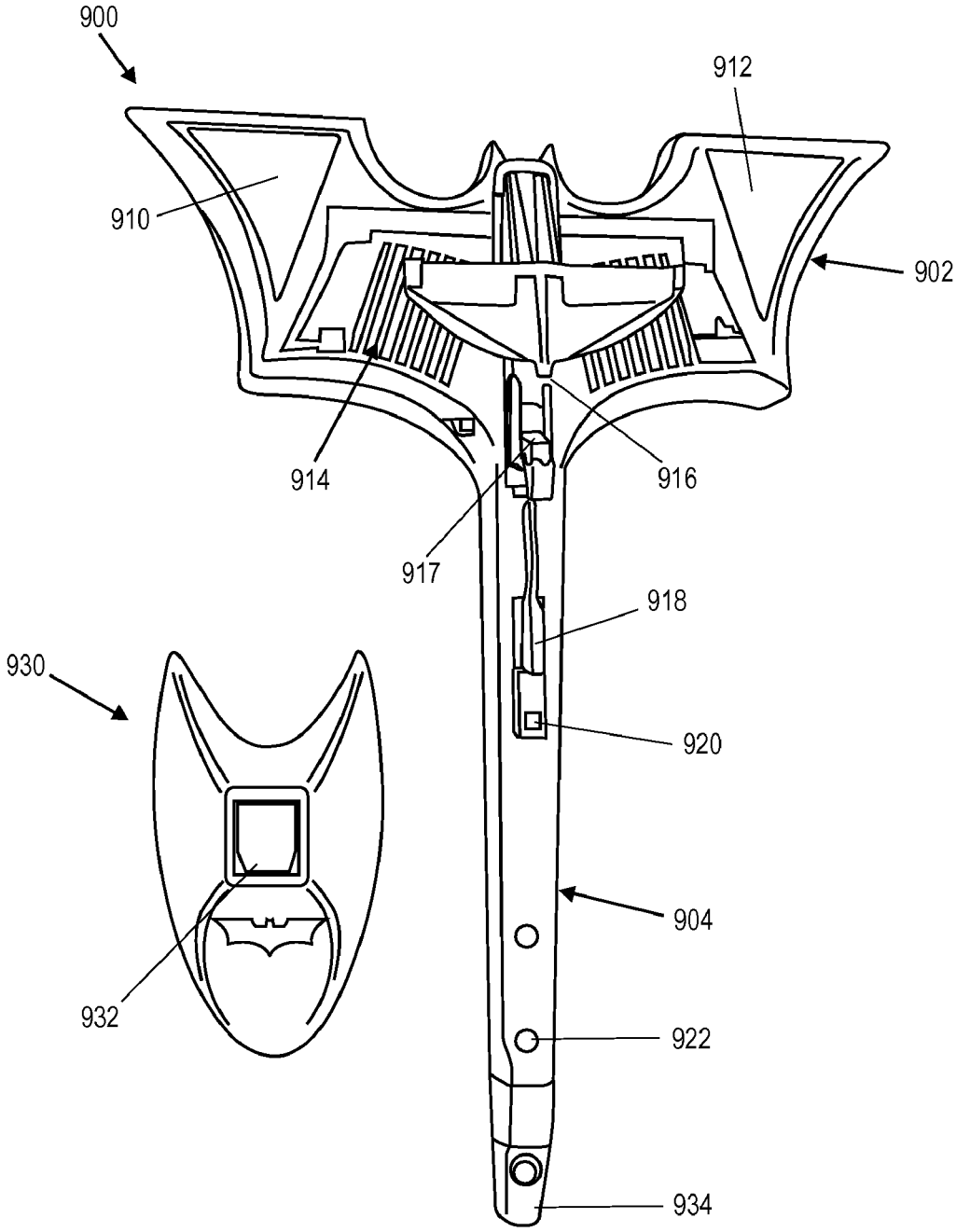
FIG. 10 illustrates a front view of a final exemplary embodiment of a launching device in accordance with the present invention.

FIG. 10 illustrates a front view of a final exemplary embodiment of launching device 900. Upper housing 902 includes an electronics button 910, a release button 912, a speaker area 914, a locator element 916 and a release element 917. In this example, electronics button 910 is enabled when the flying toy is properly attached to launching device 900. When enabled and pressed by a user, electronics button 910 turns on sounds and light effects. These effects may occur for a predetermined period of time, in a random way or in a sequenced way as desired for entertaining a user. In one example, the sounds may be random bat screeches and the light effects may be light-piped into the flying toy so that the flying toy's eyes are illuminated. A sleep-mode is optional during normal operation so that sound and light effects are off for a random amount of time (e.g., two to 10 minutes) and then automatically turned on as if the toy has awakened. Thus, the sleep-mode allows the combined launching device and flying toy to replicate the actions of a live animal or of a toy with motion, infrared or other input sensors for triggering responsive sounds and lights.

The other button on the front of upper housing 902 is release button 912, which releases a spring (not shown) for launching the flying toy off launching device 900. In this example, speaker area 914 is located between buttons 910 and 912 and outputs the sounds for the sound effects. Speaker area 914 may be located anywhere on upper housing 902 or lower housing 904. Also, any commercially available sound producing electronics may be used within launching device 900 to produce the desired sound effects.

Turning now to the last features indicated on upper housing 902, locator element 916 is used to assist with holding the flying device in a resting position against launching device 900. Locator element 916 may be a pin, rib or other element that is able to engage with a matching element on the flying toy. Some flying devices contain an elastic band that is wound and then released to provide a force for flapping the flying device's wings. If this type of flying device is used, then the winding arm may include a matching hole that engages with locator pin 916 so that the elastic band is held in a wound position until launching takes place. In an alternative embodiment, the wound elastic band may be coupled to the flying device's wings in a way so that the elastic band is held in the wound position when the wings are held in a folded position. The wings are placed in a folded position by rotating the top of each wing up to the tail area. The next feature on upper housing 902 is release element 917 located directly below locator pin 916 and used to propel the flying device away from launching device 900. For example, release element 917 may strike the edge of the winding arm on the flying toy to throw it away from launching device 900.

Lower housing 904 includes a locator rib 918, a detection button 920, a light source 922, and an insertion end 934. To secure the flying device to launching device 900, second locator element 918 may be utilized. In this example, locator element 918 is a rib element that engages with a slot in the flying toy to assist with holding the flying toy on launching device 900 in a resting position. This is an optional element. In an alternative embodiment, three or more locator elements are used (not shown). Below locator element 918 is detection button 920 which detects whether the flying toy is properly attached to launching device 900. If the flying toy is properly attached, then detection button 920 is depressed in a way that enables the electronic effects of launching device 900. Light source 922 is located below detection button 920 on top of lower housing 904 and provides a light source that may be light-piped up through the flying toy to illuminate features on the flying toy such as the flying toy's eyes. The flying toy may contain a clear plastic tube with an opening on the body of the toy for receiving light from light source 922. The tube may then branch off to provide an opening for illumination near each eye area of the toy.

In this embodiment of the invention, a base 930 is utilized for placing launching device 900 in an upright, resting position. Base 930 includes a hole 932 for inserting insertion end 934 of lower housing 904. When launching device 900 is properly placed in base 930, the flying toy may be placed in its resting position in the launching device via, for example, locator pin 916, locator rib 918 and gravitation force (shown below in FIG. 12).

Figure 11:
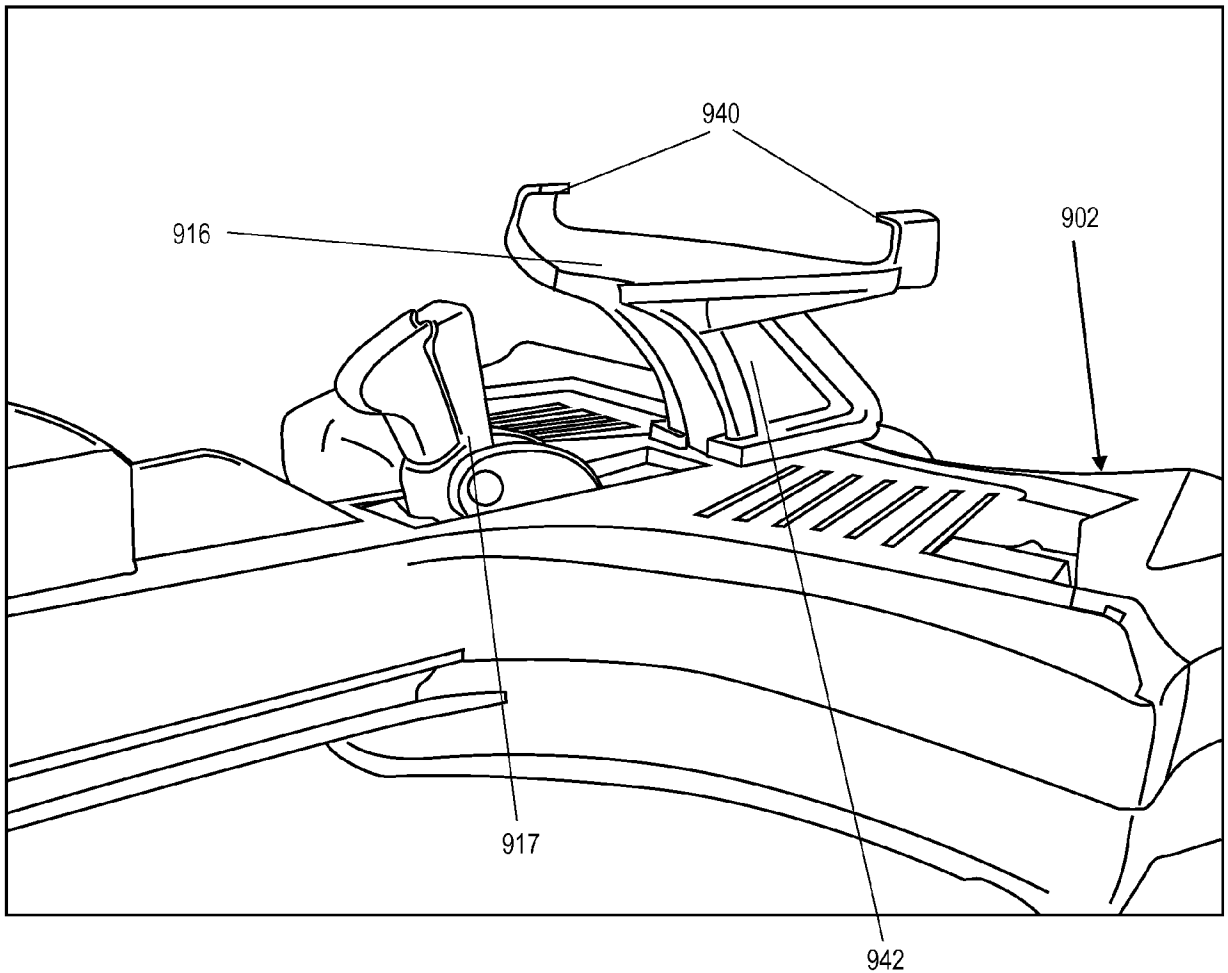
FIG. 11 further illustrates features of FIG. 10.

Turning now to FIG. 11, features of FIG. 10 will be described in greater detail. Locator pin 916 is shown between wing catch tabs 940 and on top of hammer reset arm 942. Wing catch tabs 940 are used to hold the wings of the flying toy in a folded or resting position which may also hold the elastic band within the flying toy in a wound position. Hammer reset arm 942 provides the user with a means for loading the launching device. The user pulls back on reset arm 942 to compress the launching spring and hold it in a compressed position so that it may later be release via compression of the release button to propel release hammer 917 forward. Thus reset arm 942 and release hammer 917 are mechanically linked, and this link may be located inside upper housing 902, as set forth in FIG. 11, or externally (not shown). Also, a larger spring may be utilized within upper housing 902 to reduce the locking force. If a larger spring is used, upper housing 902 may extend outward where release hammer 917 is located (not shown) to accommodate the size of the larger spring. When release hammer 917 is propelled forward, it pushes or launches the flying toy away from launching device 900 which causes the wings to be released from wing catch tabs 940 so that the elastic band is allowed to unwind and provide the force to flap the wings of the flying toy. Thus, with the press of a single button, the flying toy is propelled away from launching device 900, flaps its wings and flies away.

Figure 12:
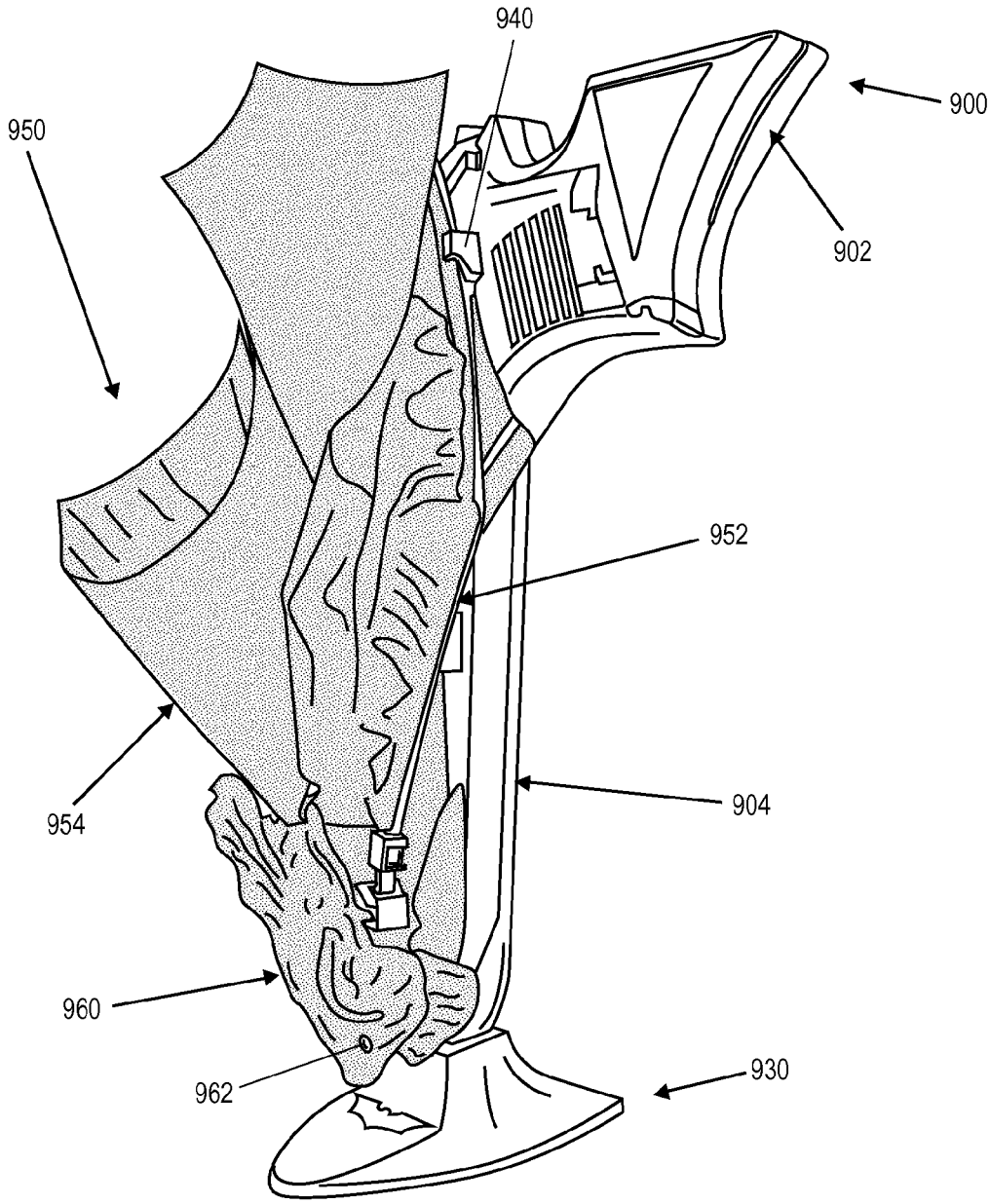
FIG. 12 illustrates a final exemplary embodiment of a launching device coupled to a flying toy.

FIG. 12 illustrates the final exemplary embodiment of launching device 900 coupled to a flying toy 950. The launching device 900 and flying toy 950 are in the resting position, and lower housing 904 is coupled to base 930 in the upright position discussed above. In this example, flying toy 950 is a bat, but as set forth above, other toys may be used such as birds, dolls, animals, fanciful characters and the like. Flying toy 950 includes a semi-rigid wing frame 952, a flexible wing material 954, a head and body portion 960 and eyes 962. Tab 940, located on upper housing 902, holds a piece of frame 952 so that frame 952 and wing material 954 are held in a folded or resting position. Again, in one example, this also holds the elastic band inside flying toy 950 in a wound position. In this resting position, all locating elements on housings 902 and 904 are lined up and engaged with flying toy 950, and the detection button is properly engaged so that the electronic features are enabled.

Light from the light source in lower housing 904 is light-piped through bat body and head 960 to illuminate eyes 962. Thus, there is no need to include electronics and power devices within flying toy 950. Both sounds and light is provided by launching device 900 so that flying toy 950 appears to be producing both effects. This provides the desired entertainment value without heavy components located in flying device 950 so that the lighter flying device 950 may fly better and longer.

Figure 13:
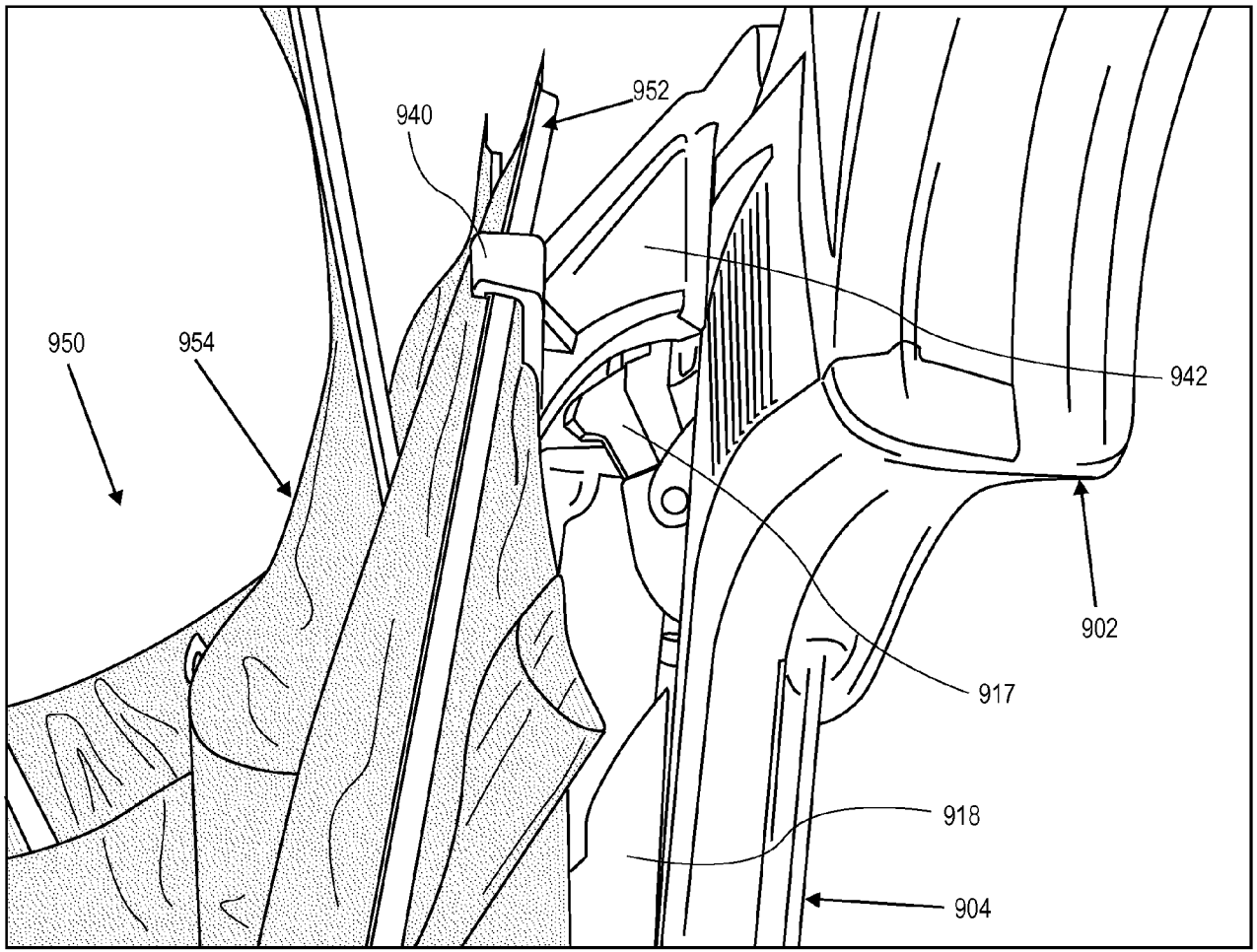
FIG. 13 further illustrates features of FIG. 12.

Turning now to FIG. 13, features of FIG. 12 will be described in greater detail. In this FIG. 13, both hammer reset arm 942 and release hammer 917 are in the loaded positions. Flying toy 950 is engaged with locator rib 918 and the locator pin. A portion of wing semi-rigid support structure 952 is held in the folded position by rib 940, which also holds flexible wing material 954 in the folded position.

Figure 14:
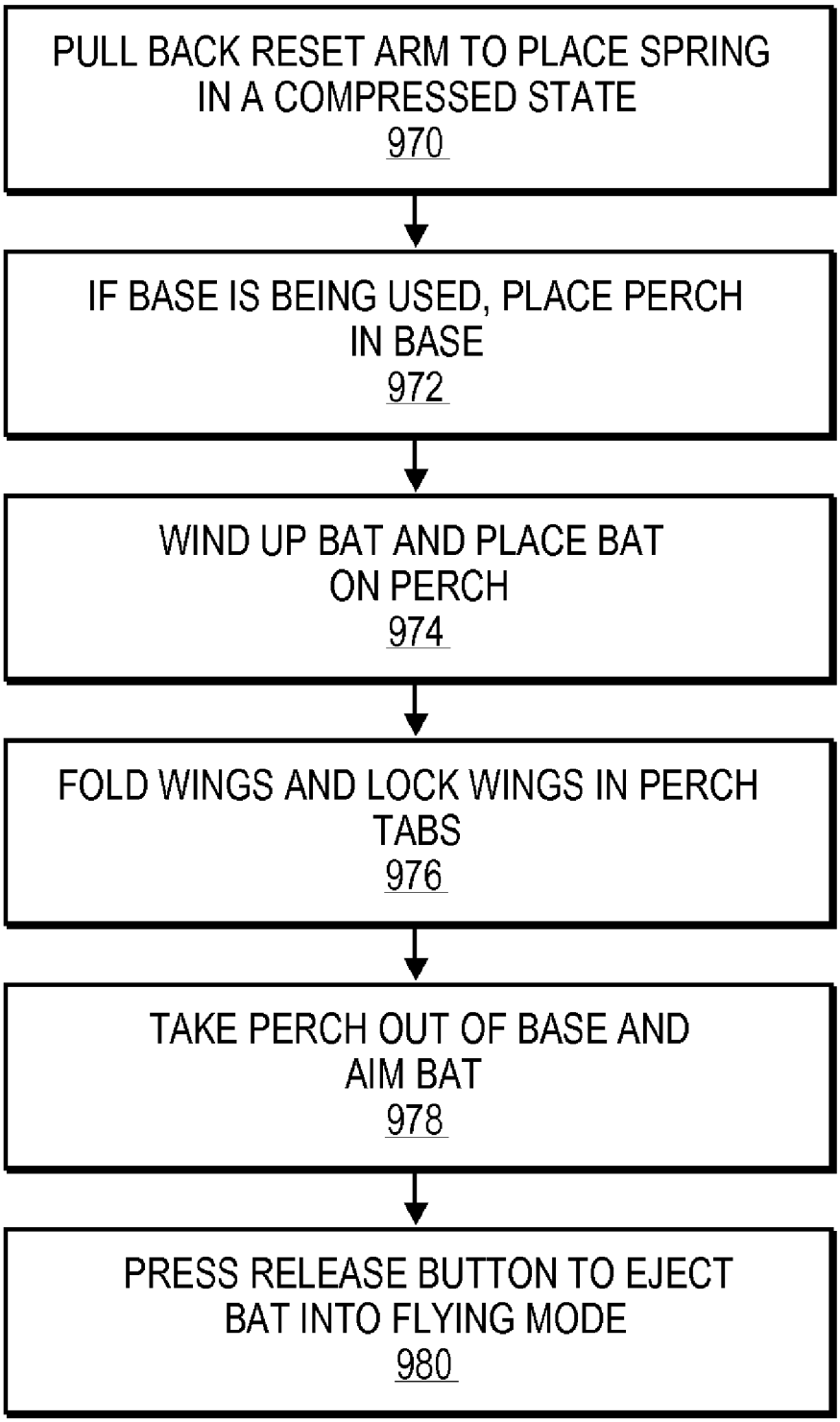
FIG. 14 is a process flowchart for the final exemplary embodiment of the present invention.

FIG. 14 is a process flowchart for the final exemplary embodiment of the present invention. At step 970, the user pulls back the reset arm to compress the spring and hold it in the compressed position. If a base is being used with the launching device, referred to as a perch in this example, then at step 972, the perch is placed in the base so that it remains in an upright position. At step 974, the user winds up the flying toy, referred to as a bat in this example, and places the bat on the perch. As described above, this is done by placing the bat onto the perch's locator elements. At step 976, the user folds up the bat's wings and locks the wings in the perch using the perch's wing tabs. When the user is ready to launch the bat, the user takes the perch out of the base at step 978 and then points the head of the bat in the direction of desired flight by aiming the lower housing of the perch. At step 980, the user presses the release button which releases the loaded spring within the perch providing a force to the perch's release hammer. The release hammer ejects the bat away from the perch which disengages the bat's wings from the perch's ribs and causes the wings to flap. The bat then flies away from the user. Thus, unlike the prior embodiment, a two-step maneuver is not needed to launch the flying toy. In this embodiment, only the release hammer provides a single force to launch the flying toy into the flying mode of operation.

Although the apparatuses of this invention have been depicted with certain embodiments of wings, bars, buttons, pins, hammers, ribs, switches and the like, other various of these play features are possible. For instance, flapping fins or other protrusions along with parachute configurations may be used instead of wings on the flying toy. Furthermore, the support bar may be square or otherwise unsmooth to facilitate rotation of the flying toy. In other variations, user input mechanisms may not be in the form of buttons. For example, a sliding mechanism, lever or the like may be used. Other play features and decorations may be applied to both the launching device and the flying toy.

While the specification has been described in detail with respect to specific embodiments of the invention, it will be appreciated that those skilled in the art, upon attaining an understanding of the foregoing, may readily conceive of alterations to, variations of, and equivalents to these embodiments. These and other modifications and variations to the present invention may be practiced by those of ordinary skill in the art, without departing from the spirit and scope of the present invention, which is more particularly set forth in the appended claims. Furthermore, those of ordinary skill in the art will appreciate that the foregoing description is by way of example only, and is not intended to limit the invention. Thus, it is intended that the present subject matter covers such modifications and variations as come within the scope of the appended claims and their equivalents.

What is claimed is:

1. A launching device for launching a flying toy, comprising:

a locator device providing gravity support to said flying toy when said flying toy is in a resting position;

a holding element comprising a pair of tabs for directly holding a wing of said flying toy in a retracted position when said flying toy is in said resting position; and a launch-assist mechanism for providing a launching force to propel said flying toy from said resting position into a flying position, wherein said launch-assist mechanism comprises a lever and a spring, wherein said lever is pulled back to load said spring, and wherein said spring is used to create said launching force.

2. The launching device of claim 1, further comprising:

electronic components for creating sound, said sound being of a type associated with said flying toy; and a speaker for projecting said sound from said launching device.

3. The launching device of claim 1, further comprising a button for triggering said launch-assist mechanism to provide said launching force.

4. The launching device of claim 3, wherein said launching force removes said wing from said holding element, allowing said wing to expand from said retracted position without additional input.

5. The launching device of claim 1, further comprising a light source for creating light, wherein said light is output from said flying toy.

6. The launching device of claim 1, further comprising electrical contacts and an electrical power source for completing an electrical circuit in said flying toy; wherein a light source located on said flying toy is energized by said electrical power source.

7. The launching device of claim 1, further comprising;

an electronic power source;

an electronic feature coupled to said electronic power source; and a sensor coupled to said electronic power source, said sensor sensing if said flying toy is properly placed on said locator device;

wherein said electronic feature is enabled when said sensor senses that said flying toy is properly placed on said locator device.

8. A launching device for launching a flying toy, said flying toy including a retractable wing, comprising:

a locator device providing gravity support to said flying toy when said flying toy is in a resting position;

a launch-assist mechanism for providing a launching force to propel said flying toy from said resting position into a flying position, wherein said launch-assist mechanism comprises a lever and a spring, wherein said lever is pulled back to load said spring, and wherein said spring is used to create said launching force;

a user input for triggering said launch-assist mechanism; and a holding element comprising a pair of tabs for directly holding said wing in a retracted position, wherein said launching force removes said wing from said holding element without additional user input when said user input triggers said launch-assist mechanism.

9. The launching device of claim 8, further comprising;

an electronic power source;

an electronic feature coupled to said electronic power source; and a sensor coupled to said electronic power source, said sensor sensing if said flying toy is properly placed on said locator device;

wherein said electronic feature is enabled when said sensor senses that said flying toy is properly placed on said locator device.

10. The launching device of claim 8, further comprising a light source for creating light, wherein said light is output from said flying toy.

* * * * *